US011407026B2

(12) United States Patent
Lüngen et al.

(10) Patent No.: US 11,407,026 B2
(45) Date of Patent: Aug. 9, 2022

(54) ROLLING INGOT MOULD FOR THE CONTINUOUS CASTING OF ALUMINIUM AND ALUMINIUM ALLOYS

(71) Applicant: CASTHOUSE REVOLUTION CENTER GMBH, Braunau-Ranshofen (AT)

(72) Inventors: Ralf Wilhelm Ernst Lüngen, Amriswil (CH); Thomas Willem Jumelet, Berg (CH)

(73) Assignee: CASTHOUSE REVOLUTION CENTER GMBH, Braunau-Ranshofen (AT)

( * ) Notice: Subject to any disclaimer, the term of this patent is extended or adjusted under 35 U.S.C. 154(b) by 0 days.

(21) Appl. No.: 17/299,143

(22) PCT Filed: Nov. 22, 2019

(86) PCT No.: PCT/EP2019/082213
§ 371 (c)(1),
(2) Date: Jun. 2, 2021

(87) PCT Pub. No.: WO2020/114801
PCT Pub. Date: Jun. 11, 2020

(65) Prior Publication Data

US 2022/0072603 A1 Mar. 10, 2022

(30) Foreign Application Priority Data

Dec. 3, 2018 (DE) ..... 10 2018 130 698.9

(51) Int. Cl.
*B22D 11/055* (2006.01)
*B22D 11/041* (2006.01)
*B22D 11/22* (2006.01)

(52) U.S. Cl.
CPC ..... *B22D 11/055* (2013.01); *B22D 11/041* (2013.01); *B22D 11/22* (2013.01)

(58) Field of Classification Search
CPC .... B22D 11/049; B22D 11/055; B22D 11/068
See application file for complete search history.

(56) References Cited

U.S. PATENT DOCUMENTS 3,381,741 A * 5/1968 Gardner ..... B22D 11/10 164/439
4,494,594 A 1/1985 Kurzinski
(Continued)

FOREIGN PATENT DOCUMENTS

CN 101844209 A * 9/2010
DE 40 32 521 4/1992
(Continued)

OTHER PUBLICATIONS

Office Action issued in German Patent Application No. 10 2018 130 698.9, dated Aug. 27, 2019, 8 pages.
(Continued)

*Primary Examiner* — Kevin E Yoon
*Assistant Examiner* — Jacky Yuen
(74) *Attorney, Agent, or Firm* — Hamre, Schumann, Mueller & Larson, P.C.

(57) ABSTRACT

The invention relates to a cooling system for a mould, in particular a mould for vertical continuous casting, comprising at least one cooling unit (11), wherein the mould has a running surface (10) with an inner side and an outer side and the inner side of the running surface (10*a*) limits a continuous casting during operation, wherein the cooling unit (11) is designed to be moveably arranged on the mould and the cooling unit (11) has an adjusting element (13), wherein the cooling unit (11) is arranged on the mould in such a way that a gap (12) is formed between the cooling unit (11) and the
(Continued)

Figure 1:
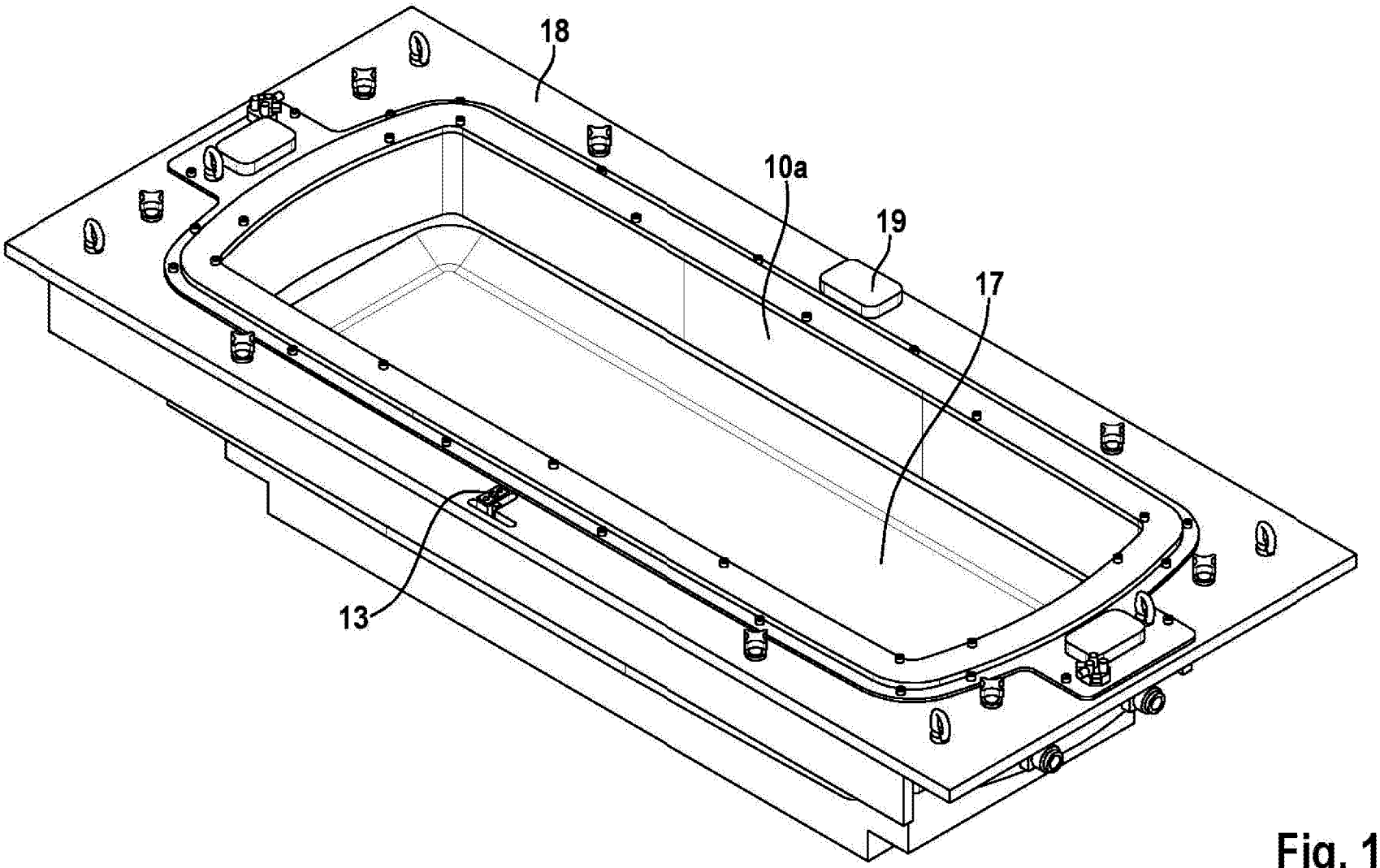

outer side of the running surface (10) and the width of the gap (12) can be adjusted by the adjusting element (13).

14 Claims, 4 Drawing Sheets

(56) References Cited

U.S. PATENT DOCUMENTS

| | | | |
|---|---|---|---|
| 5,257,659 | A | 11/1993 | Maag |
| 2005/0034838 | A1 | 2/2005 | Koibeck et al. |

FOREIGN PATENT DOCUMENTS

| | | |
|---|---|---|
| DE | 103 37 205 | 3/2005 |
| EP | 2 572 812 | 3/2013 |
| GB | 1 331 333 | 9/1973 |
| JP | 2004-167521 | 6/2004 |
| WO | 02/085555 | 10/2002 |
| WO | 2005/092540 | 10/2005 |

OTHER PUBLICATIONS

International Search Report issued in International Application No. PCT/EP2019/082213, dated Jan. 10, 2020, 4 pages w/translation.

* cited by examiner

ROLLING INGOT MOULD FOR THE CONTINUOUS CASTING OF ALUMINIUM AND ALUMINIUM ALLOYS

The invention relates to a cooling system for a mould with the features of the preamble of Claim 1. The invention furthermore relates to a mould and a method for continuous casting.

A cooling system of the type mentioned above is known, for example, from WO 2005/092540 A1.

During vertical continuous casting, melt flows continuously through a cooled, bottomless mould. The melt begins to solidify in the mould in the edge region. A so-called strand shell is formed. On the inside, the strand is liquid. The melt is then continuously pulled off in a downward direction as a strand or drained off by gravity.

The contact of the melt with the cooled mould wall solidifies a thin shell, which encloses a "sump" and prevents direct contact between the melt and cooling water when the casting table is slowly lowered (30 to 85 mm/min.) and as the mould chamber is continuously fed via a runner. The further cooling of the ingot is carried out by direct contact between the cooling water and the ingot surface.

Critical factors must be observed during the starting process of the mould. For example, due to the higher thermal conductivity of aluminium during the starting process, permanent deformations, in particular, "butt swell" and "butt curl", may occur.

"Butt swell" denotes a thickening of the strand foot compared to the rest of the strand. The mould is initially sealed from below by a starting block. The starting block is cooled like the mould. During the starting process, the melt flows into the mould and encounters the cooled starting block. The starting block is not moved out of the mould until the mould is filled. For this reason, the liquid core or sump of the strand is much smaller during the starting process than during the course of the rest of the continuous casting process. On the one hand, this condition results from the lower casting speed during the starting process and from the additional cooling by the starting block on the other. Therefore, the degree of shrinkage is also reduced, and the strand has approximately the same extensive dimensions as the inner dimensions of the mould.

"Butt curl" denotes a deformation at the end of the strand foot. During the starting process, the strand, in particular, the strand foot, is cooled by the mould, the starting block and the cooling water, which is sprayed onto the strand at the outlet of the mould. This leads to a cooling of the melt. The resulting stresses are greater than the strength of the strand, thereby causing a deformation of the strand foot in the form of a convex curvature. The convex curvature also causes an inward diffraction of the outer sides of the strand. This effect makes the "butt swell" even more apparent. In the worst case, the temperature shock can cause cracks, through which liquid metal leaks.

In order to reduce the formation of undesirable deformations during continuous casting, cooling systems are used, which allow a targeted cooling of the strand, particularly during the starting process.

A mould with such a cooling system is known from WO 2005/092540 A1. The described mould is used for the continuous casting of non-ferrous materials, in particular, aluminium and aluminium alloys. Cooling is carried out by cooling elements, which are designed as nozzles and are distributed across the perimeter within the framework of the mould. The nozzles assigned to the middle region of the strand have a larger diameter than the nozzles that are assigned to the edge region of the strand. The larger diameter reduces the volumetric flow and thus the cooling in the middle range of the strand. This is intended to reduce the stresses that occur and minimize deformations.

In the above example, however, the cooling can only be controlled via the volumetric flow and the composition of the cooling medium. No other ways to control solidification behaviour to further minimize deformations are provided. The deformations must be separated after the strand has completely solidified. This process is material, cost- and time-consuming. The continuous casting of different aluminium alloys with a single mould of the above type is not possible, since the arrangement of the nozzles in the mould framework is adapted to the respective material to be casted and cannot be changed.

The invention is therefore based on the object to improve a cooling system of the type mentioned above so that the continuous casting of different materials with a mould is possible, wherein deformations, which may occur during continuous casting, are reduced. Furthermore, the object of the invention is to indicate a mould with such a cooling system and a method for continuous casting with such a cooling system.

According to the invention, the task is achieved, with respect to the cooling system, by means of the object of Claim 1, with respect to the mould, by means of Claim 13, and, with respect to the method, by means of the object of Claim 14.

Specifically, the task is achieved by means of a cooling system for a mould, in particular, a mould for vertical continuous casting, which comprises at least one cooling unit, wherein the mould has a running surface with an inner side and an outer side, and the inner side of the running surface limits a continuous casting during operation. The cooling unit is designed to be moveably arranged on the mould, wherein, between the cooling unit and the outer side of the running surface, a gap is formed, and the width of the gap can be adjusted by means of an adjusting element.

The moveable cooling system arranged on the mould makes a new additional parameter available that influences the continuous casting process. By adjusting the distance of the cooling unit, temperature changes of running surface and the cooling medium can be responded to. Using the cooling system according to the invention, it is possible that different materials, in particular different aluminium alloys, can be cast with the same mould since the mould can be adjusted to the solidification behaviour of the respective material via the additional parameter of the moveable cooling system. The solidification behaviour of a material is specifically influenced during the starting process in particular. For example, by reducing the cooling during the starting process, the stresses in the material generated by the temperature shock can be reduced. This minimizes deformations, particularly "butt swell" and "butt curl".

Preferred embodiments of the invention are indicated in the subclaims.

In one embodiment of the invention, the mould has a plurality of running surfaces, to which each a moveable cooling unit is assigned, wherein the running surfaces limit the continuous casting and, between the outer sides of the running surfaces and the cooling units, a gap running around the mould is formed. The contour of the circumferential gap can be completely closed or partially open. Since each running surface has its own cooling unit with an adjusting element, the cooling of each running surface can be adjusted individually. Rectangular mould profiles are preferable.

Alternatively, other profiles are possible. For example, the mould can be designed as a round profile. To cool the running surface of the round profile, a plurality of cooling units are arranged around the running surface of the round profile. The cooling units can be bent or straight.

Expediently, the cooling unit comprises at least one means for cooling, which is arranged on the side of the cooling unit facing the outer side of the running surface. As a result, the means for cooling is aligned with the region of the mould or strand to be cooled, thus enabling direct and efficient cooling.

It is particularly favourable if the means for cooling comprises a primary means for cooling, which is directed onto the outer side of the running surface, and comprises a secondary means for cooling, which is directed onto a region that is subordinate to the mould outlet in the casting direction. This gives the advantage that with a cooling unit both the outer side of the running surface as well as the strand or the starting block can be cooled. The primary means for cooling has the function of applying cooling medium to the outer side of the running surface to cool the running surface and thus the melt or strand in the mould. The secondary means for cooling is directed onto a region after the mould outlet, where the strand leaves the mould again or closes the mould at the beginning of the starting block. It is conceivable that more than one means for cooling is directed onto the mould or the strand.

The means for cooling comprises at least one oblong opening that extends at least partially along a longitudinal axis of the cooling unit and/or comprises a plurality of circular openings, which are arranged at least partially along a longitudinal axis of the cooling unit. The shape of the means for cooling influences the amount of the cooling medium applied. This allows a controlled application of the cooling medium to the outer side of the running surface and different application speeds, whereby the solidification behaviour can be specifically influenced.

Preferably, the cooling unit comprises at least one cooling chamber with at least one infeed for cooling medium. This has the advantage that the cooling medium accumulates in the cooling chamber and an overpressure forms, which is evenly distributed in the cooling chamber.

Preferably, the cooling chamber is fluidically connected to the means for cooling. The fluid connection and the evenly distributed overpressure in the cooling chamber cause the means for cooling to apply the cooling medium to the region to be cooled. If the same pressure acts on the means for cooling over the entire longitudinal axis of the cooling unit, the application speed and quantity of the cooling medium primarily depends on the number and size of the openings of the means for cooling.

In a further preferred embodiment, the adjusting element comprises at least one guide, in particular, a rail on which the cooling unit is moveably mounted perpendicularly to the running surface. The guide has the advantage that the cooling unit is moveably mounted, and it is therefore easy to change the width of the gap. The bearing on a guide or on a rail allows for the implementation of a good holding function, wherein, despite large temperature fluctuations, mobility is maintained perpendicular to the running surface assigned to the cooling unit.

It is favourable if the adjusting element comprises at least one adjusting element, in particular, an adjusting screw, by which the width of the gap can be adjusted. An adjusting screw allows for an infinitely variable adjustment of the gap width by interacting with a tool. Alternatively, other control elements are conceivable.

Expediently, the adjusting element comprises at least one locking element, in particular, a locking screw, which locks the cooling unit on the guide. During operation, this ensures that the gap width does not change during continuous casting. Other locking elements, for example, locks, are possible.

In a particularly preferred embodiment, the adjusting element comprises a control system and/or a controller and an actuator, in particular, an electric actuator, for adjusting the gap. This allows the cooling system to adjust the gap width automatically and as required. During the control process, the cooling system carries out a predetermined behaviour or a predetermined flow. The controller compares the temperature of the running surface (actual value) with a predetermined temperature value (target value) in real time. In the event of deviations, the temperature of the running surface is corrected by changing the gap width with the aid of the actuator and/or another actuator. Other types of actuators are possible instead of an electric actuator. For example, a pneumatic or hydraulic linear actuator is conceivable as an actuator. In addition, it is conceivable that further control variables are possible that influence the temperature of the outer surface by means of a corresponding actuator engaging. For example, by feeding additives into the cooling medium or by changing the casting speed of the melt.

Favourably, at least one temperature sensor is arranged on the running surface. The sensor enables the monitoring and return of the temperature value of the running surface within the control circuit. For temperature measurement, all common methods suitable for the high-temperature range are conceivable.

Favourably, at least one temperature sensor is arranged on the cooling unit. This has the advantage that the cooling system can react to the temperature of the cooling medium. A temperature of the cooling medium that is too high impairs the cooling effect. For temperature measurement, all common methods suitable for the high-temperature range are conceivable.

Within the scope of the invention, a mould with a cooling system according to the invention is disclosed and claimed, wherein the cooling system encloses the mould in the circumferential direction at least in sections.

Specifically, a mould, in particular for vertical continuous casting, is claimed, which comprises a cooling system with at least one cooling unit and a running surface with an inner side and an outer side, wherein the inner surface of the running surface limits a continuous casting during operation. The cooling unit is moveably arranged on the mould and has an adjusting element, wherein the cooling unit is arranged on the mould in such a way that a gap is formed between the cooling unit and the outer side of the running surface and the width of the gap can be adjusted via the adjusting element.

Furthermore, within the scope of the invention, a method for continuous casting, in particular for vertical continuous casting, with a mould according to Claim 14 is disclosed and claimed. The method initially involves adjusting the gap to the width required for the material to be casted via the adjusting element. The starting block is then placed in a starting position. Optionally, the starting block and the running surface can be cooled to the required initial temperature. Then the continuous supply of melt into the mould begins with continuous cooling. As soon as the mould has reached a certain level, the starting block is lowered, wherein the melt is pulled through the mould. At least during the starting phase, the process parameters are monitored, and the strand is cooled in a controlled manner when it exits the mould.

The invention is described in the following based on a plurality of exemplary embodiments making reference to the enclosed schematic drawings with further details.

Figure 2:
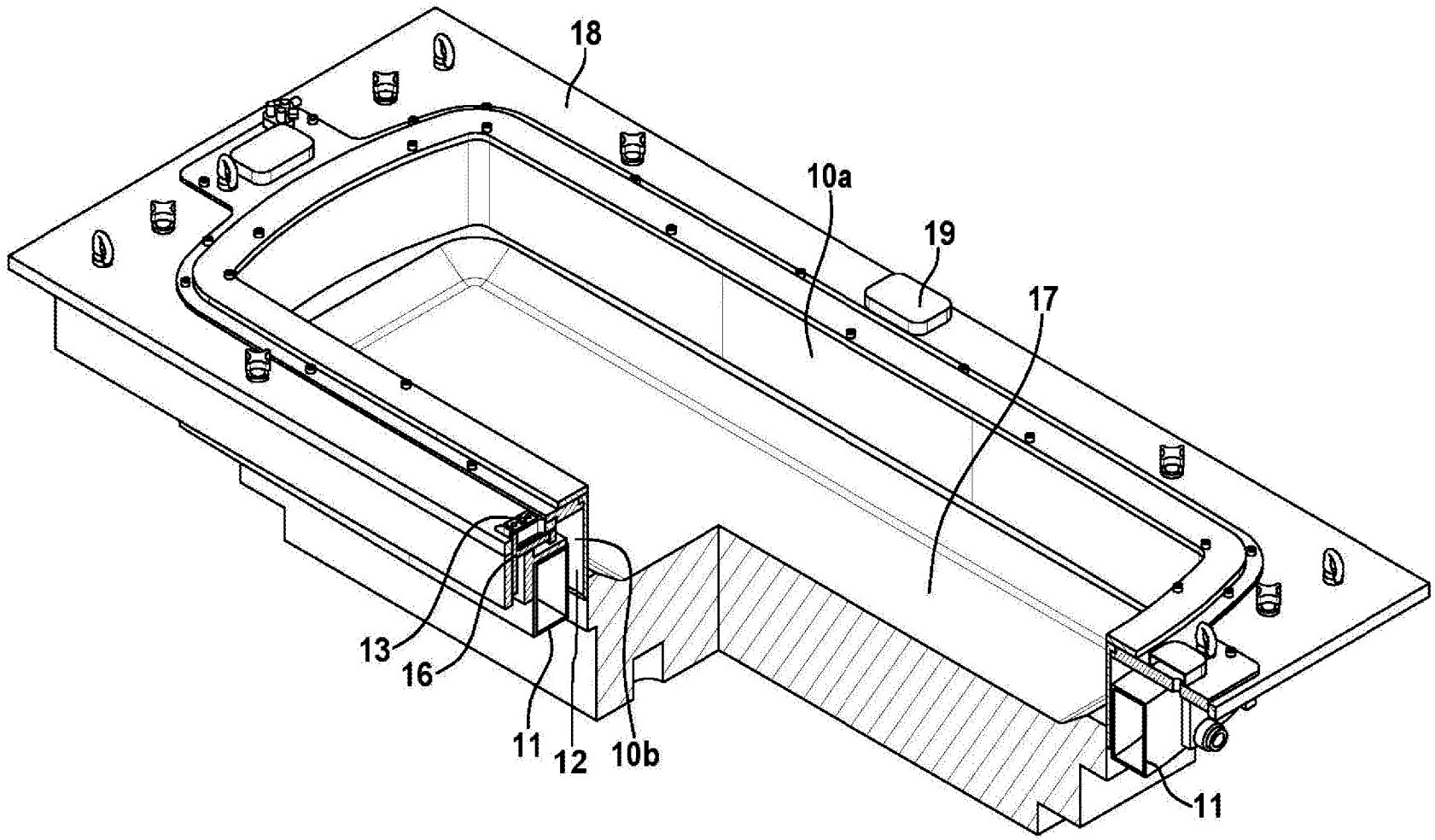

The figures show:

FIG. 1 a perspective view of an exemplary embodiment of a mould according to the invention with a cooling system FIG. 2 a perspective view with a partially sectioned mould according to FIG. 1

Figure 3:
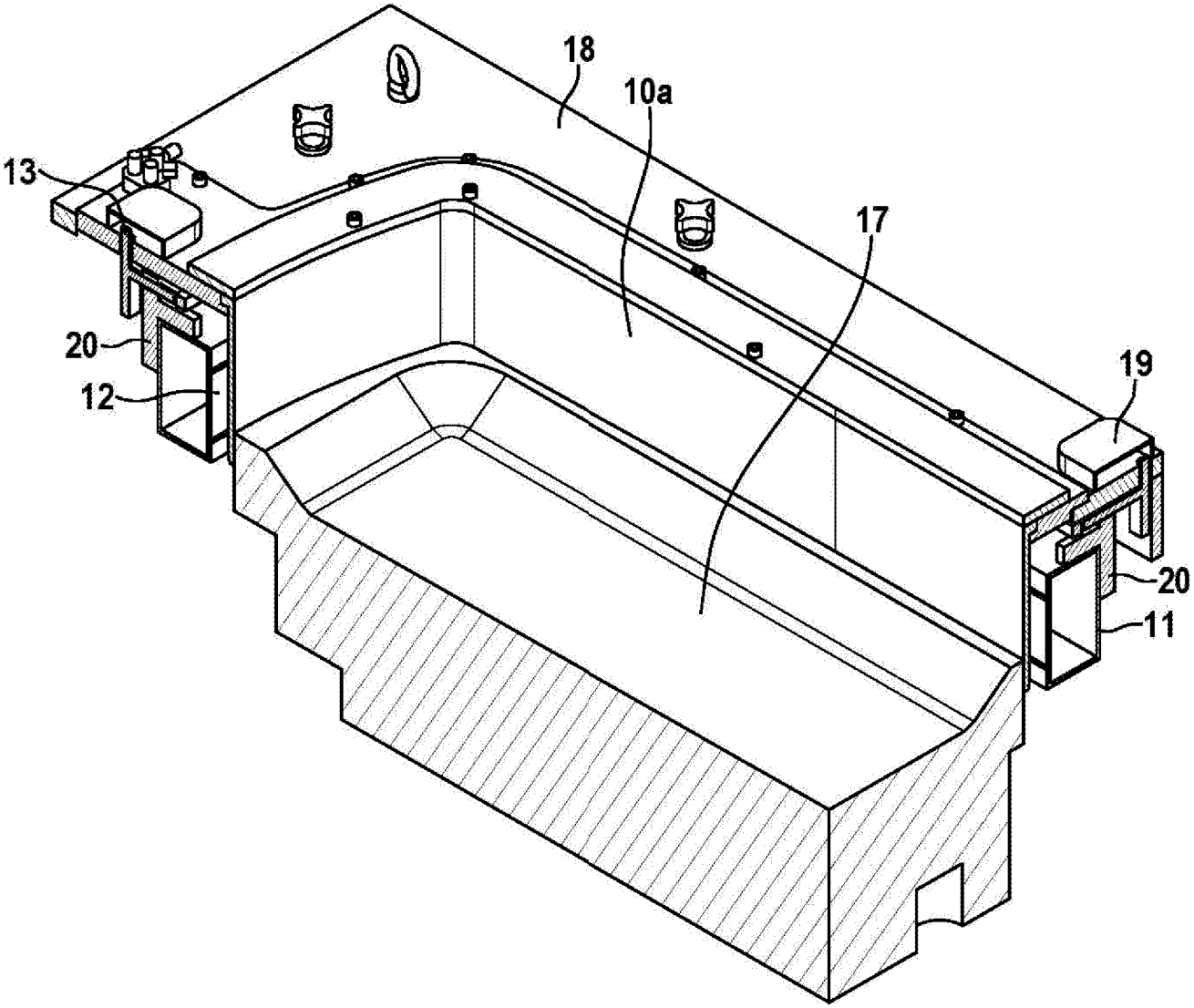

FIG. 3 a perspective view with a partially sectioned mould according to FIG. 1

Figure 4:
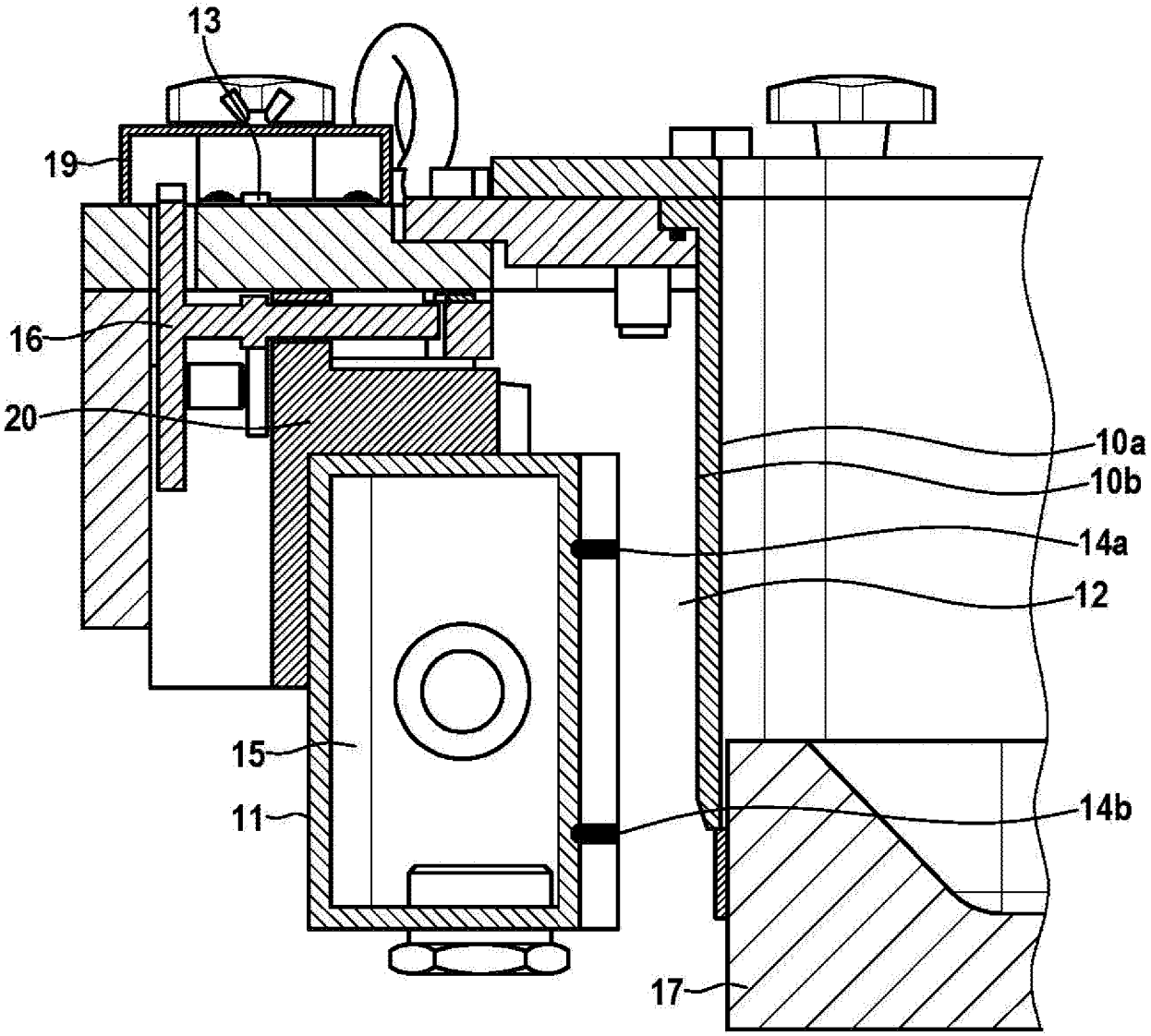

FIG. 4 a detailed view of an exemplary embodiment of a cooling system with an adjusting element according to the invention The cooling system comprises a cooling unit 11, which is assigned to a running surface 10 with an inner side 10*a* and an outer side 10*b* and is spaced away from the outside 10*b* of the running surface by means of a gap 12. Furthermore, the cooling system comprises an adjusting element 13, via which the width of the gap 12 can be adjusted.

FIG. 1 shows a mould with a cooling system. The profile of the mould is rectangular and designed for casting slabs. It is also conceivable that the cooling system is used for other moulds. The cooling system can also be used for moulds with round or square profiles, e.g., for the continuous casting of round ingots (billet).

The mould comprises a mould inlet and a mould outlet. The melt enters the mould through the mould inlet. The partially solidified melt exits the mould again from the mould outlet.

The mould comprises a collar 18, which extends within the region of the mould inlet across the circumference of the mould. At the side of the collar 18 directed onto the mould outlet, one cooling unit 11 is respectively arranged on the longitudinal and transverse sides of the mould, which can be adjusted independently of one another. The side of the collar 18 directed toward the mould inlet comprises coverings 19, which are each arranged in the middle on the longitudinal and transverse sides. The adjusting elements 13 for the cooling units 11 are arranged under the coverings 19.

At the mould outlet, a starting block 17 is arranged, which seals the mould, i.e., the starting block 17 is arranged in the mould so that, between the inner side of the running surface 10*a* and the starting block 17, a circumferential gap (approx. 2 mm) is formed, wherein this gap is sealed by the first rapidly solidifying metal. The starting block 17 seals the mould in the starting direction during the starting process until the melt in the mould has reached a sufficient filling level and is solidified to the extent that the mould outlet can be opened. For this purpose, the melt is initially pulled out of the mould with the starting block 17. After shrinkage, further drainage takes place with the help of gravity.

The inner side of the running surface 10*a* limits the melt that is pulled through the mould during operation and removes heat from the melt. In order to meet the high-temperature requirements, in the case of casting non-ferrous materials, moulds made of special aluminium alloys and copper alloys are also used. Other materials are possible.

In order to cool the running surface 10, a cooling medium is applied to the outer side 10*b* of the running surface, specifically being sprayed on. For example, water can be used as a cooling medium. Other fluids or fluid mixtures are conceivable. The running surface 10 comprises two transverse sides and two longitudinal sides. A cooling unit 11 is assigned to the two transverse sides and the two longitudinal sides of the running surface 10*b*. The cooling units 11 are arranged parallel, in particular, congruently, to the running surface 10. The profile of the cooling units 11 is rectangular. Other geometries, such as circular geometries, are possible. The cooling units 11 comprise a cooling chamber 15 on the inside. In general, the cooling chamber 15 has a rectangular profile. Alternatively, other forms are also possible. The cooling chamber 15 is fluidically connected to a means for cooling 14. The means for cooling 14 may be designed, for example, as nozzles or bore holes. Other variants are conceivable. The means for cooling 14 is described in more detail in one of the following sections. The cooling chamber 15 has the function of collecting the cooling medium and directing it into the means for cooling 14. It is conceivable that the cooling unit 11 comprises a plurality of cooling chambers 15 and/or a plurality of means for cooling 14.

FIGS. 2 and 3 are respectively partial-section illustrations of FIG. 1. In these examples, the cooling unit 11 and the adjusting element 13 are particularly visible. The adjusting element 13 forms an adjustable connection between the cooling unit 11 and the mould. To protect against external influences, the adjusting element 13 is arranged under the covering 19.

The adjusting element 13 comprises a guide 16. The guide 16 is designed as a rail. Alternatively, other components that can be used as a guide 16 are conceivable. The rail extends persevere in the direction of the running surface 10, which is assigned to the cooling unit 11. In addition, a plurality of guides 16 or rails are possible. The displacement of the cooling unit 11 on the guide 16 is carried out by a component of the adjusting element 13, such as an adjusting screw (not shown).

The adjusting element 13 can be operated manually or at least partially automated. For example, a manual adjustment can be done by means of the adjusting screw (not shown) and/or a locking screw (not shown). An automatic operation can be implemented by means of a control system or a controller (both not shown). The displacement of the cooling unit, meaning adjusting the width of the gap 12, represents an additional influencing parameter for the cooling of the mould. A small gap 12 increases the cooling effect, while a large gap reduces the cooling effect.

The cooling unit 11 comprises a retaining element 20. The retaining element 20 is shaped as a right angle and arranged precisely at an outer edge of the cooling unit 11. Other geometries for the retaining element 20 are possible. The cooling unit 11 can be moved on the guide 16 by the retaining element 20 in such a way that the cooling unit 11 can be moved perpendicular to the respectively assigned running surface 10.

FIG. 4 shows a detailed view of the cooling system within the region of the adjusting element 13. The cooling element 11 is attached to the retaining element 20. The retaining element 20 is, in turn, moveably mounted on the guide 16. A gap 12 is formed between the outer side 10*b* of the running surface and the cooling unit 11.

In this example, two means for cooling 14*a*, 14*b* are arranged on the cooling unit 11. The means for cooling 14*a*, 14*b* are designed as narrow openings, each extending along a longitudinal axis of the cooling unit 11. The means for cooling 14*a*, 14*b* are arranged on the side of the cooling unit 11, which is facing the assigned outer side 10*b* of the running surface. Alternatively, other forms are also possible for the means for cooling 14*a*, 14*b*. The means for cooling 14*a*, 14*b* are designed in such a way that the cooling medium overcomes the gap 12 between cooling unit 11 and the outer side 10*b* of the running surface. The means for cooling 14*a*, 14*b* comprise a primary means for cooling 14*a* and a secondary means for cooling 14*b*. The primary means for cooling 14*a* is directed onto the outer side 10*b* of the running surface 10*b* and thus cools the melt that passes through the mould. The secondary means for cooling 14*b* is directed onto the starting block 17. This cools the starting block 17 before and during the starting process. After the starting process, the secondary means for cooling 14*b* is no longer directed onto the starting block 17, but directly onto the strand in order to cool it.

REFERENCE LIST

10 running surface
10*a* inner side of the running surface
10*b* outer side of the running surface
11 cooling units, 2× short and 2× long
12 gap
13 adjusting element
14 means for cooling
14*a* primary means for cooling
14*b* secondary means for cooling
15 cooling chamber
16 guide
17 starting block
18 collar
19 covering
20 retaining element

The invention claimed is:

1. Cooling system for a continuous casting mould comprising at least one cooling unit, wherein the mould has a running surface with an inner side and an outer side, and the inner side of the running surface limits a continuous casting during operation, wherein the cooling unit is designed to be moveably arranged on the mould and the cooling unit has an adjusting element, wherein the cooling unit is arranged on the mould in such a way that a gap is formed between the cooling unit and the outer side of the running surface and the width of the gap can be adjusted by the adjusting element.

2. The cooling system according to claim 1, wherein the cooling unit comprises at least one means for cooling arranged on the side of the cooling unit facing the outer side of the running surface.

3. The cooling system according to claim 2, wherein the means for cooling comprises a primary means for cooling directed onto the outer side of the assigned running surface and comprises a secondary means for cooling directed onto a region subordinate to a mould outlet in a casting direction.

4. The cooling system according to claim 2, wherein the means for cooling comprises at least one oblong opening, which at least partially extends along a longitudinal axis of the cooling unit, and/or comprises a plurality of circular openings, which are at least partially arranged along a longitudinal axis of the cooling unit.

5. The cooling system according to claim 1, wherein the cooling unit comprises at least one cooling chamber that comprises at least one infeed for cooling medium.

6. The cooling system according to claim 5, wherein the cooling chamber is fluidically connected to a means for cooling.

7. The cooling system according to claim 1, wherein the adjusting element comprises at least one rail on which the cooling unit is moveably mounted perpendicular to the running surface.

8. The cooling system according to claim 1, wherein the adjusting element comprises at least one adjusting screw via which the width of the gap can be adjusted.

9. The cooling system according to claim 7, wherein the adjusting element comprises at least one locking screw which locks the cooling unit on the rail.

10. The cooling system according to claim 1, wherein the adjusting element comprises a control system and/or a controller and an electric actuator for adjusting the gap.

11. The cooling system according to claim 1, wherein at least one temperature sensor is arranged on the running surface.

12. The cooling system according to claim 1, wherein at least one temperature sensor is arranged on the cooling unit.

13. A mould with a cooling system according to claim 1, wherein the cooling system encloses the mould in a circumferential direction at least in sections.

14. Method for vertical continuous casting with the mould according to claim 13 comprising:

a. adjusting the gap to a width required for a material to be casted via the adjusting element;
b. arranging a starting block in a starting position;
c. optional: cooling the starting block and the running surface to a required initial temperature;
d. starting the continuous supply of melt into the mould with continuous cooling;
e. lowering the starting block as soon as the mould has reached a certain level, wherein the melt is pulled through the mould;
f. monitoring process parameters and the controlled cooling of the strand when exiting the mould at least during the starting phase.

* * * * *